United States Patent [19]

Diamond

[11] Patent Number: 4,864,796

[45] Date of Patent: Sep. 12, 1989

[54] VARIABLE POLYHEDRAL FRAMEWORK

[76] Inventor: Gary Diamond, 18220 Margate St., Tarzana, Calif. 91356

[21] Appl. No.: 165,844

[22] Filed: Mar. 9, 1988

[51] Int. Cl.[4] ..... E04H 12/18

[52] U.S. Cl. ..... 52/646; 52/640; 52/DIG. 10

[58] Field of Search ..... 52/DIG. 10, 81, 640, 52/646

[56] References Cited

U.S. PATENT DOCUMENTS

| | | | |
|---|---|---|---|
| 1,112,542 | 10/1914 | Loser | 52/640 |
| 3,026,651 | 3/1962 | Richter | 52/81 |
| 3,062,340 | 11/1962 | Hunnebeck | 52/640 |
| 3,354,591 | 11/1967 | Fuller | 52/81 |
| 3,662,486 | 5/1972 | Freedman | 52/DIG. 10 |
| 3,731,450 | 5/1973 | Chateau | 52/81 |
| 3,783,573 | 1/1974 | Vaughan | 52/646 |
| 4,619,099 | 10/1986 | Sircovich | 52/646 |
| 4,667,451 | 5/1987 | Onoda | 52/646 |
| 4,711,062 | 12/1987 | Gwilliam | 52/DIG. 10 |

FOREIGN PATENT DOCUMENTS

| | | | |
|---|---|---|---|
| 550519 | 12/1957 | Canada | 52/640 |
| 17215 | of 1909 | United Kingdom | 52/DIG. 10 |

OTHER PUBLICATIONS

Space Grid Structures by John Borrego ©MIT Press 1986, pp. 137–146, 164–181.

*Primary Examiner*—Henry E. Raduazo

[57] ABSTRACT

A variable polyhedral framework made from at least two joined tetrahedrons hinged at their coincident base edges, which may thereby move easily through and be made rigid in many different configurations.

2 Claims, 1 Drawing Sheet

VARIABLE POLYHEDRAL FRAMEWORK

BACKGROUND—FIELD OF INVENTION

This invention relates to polyhedral frameworks, which can be of use in structures for Engineering or Architectural applications, or in toys, especially to conditions in which a variable configuration of the final resultant shape of the framework is advantageous.

BACKGROUND—CROSS REFERENCE TO RELATED APPLICATIONS

In my prior patent, U.S. 4,502,257, 03/05/85, many new structures were disclosed, based on a generic module and a method of forming structures. one of the structures may be made of a square sheet of material, with fold lines about its diagonal corners. A structure so formed is shown in FIG. 1. From further experiments utilizing this structure, the device of the present application was developed.

BACKROUND—DESCRIPTION OF PRIOR ART

Heretofore, rigid structural frameworks made of polyhedral modules have been devised which in their final installation are made rigid and cannot be accomodated to other new final shapes without the dismantling of the structure and a re-erection using additional different shaped connectors and struts or different locations of connector points and struts to enable the new final shape to be achieved. This fact has required that a large inventory of different shapes of connectors and struts be manufactured and held in stock for an adequate availability to be presented to the users of structures, that they may have as many options as possible to create the shapes of their frameworks. For example the spherical, ellipsoid, planar, and polyhedral perimeters, that are traditionally specified by Architects and Engineers for frameworks, each require some specifically designed and milled parts to achieve their desired forms. This is of course caused by the specific geometric properties of each of these forms, which in order to achieve utilizing a polyhedral framework, each requires their own design and milling to certain angular dimensions of their connectors and their struts. This enlargens the inventory of specific parts to maintain a full polyhedral framework structural system.

In addition, the abilities of structures to resist loads from earthquakes and winds, requires that a structure be able to flex in some way to accomodate the imposed forces. Existing structures of the prior art have addressed this problem by having some of the foundation connections being roller joints which may move as required, or have increased the strengths of the members and connectors of the frameworks to resist these loads. Other methods are needed to solve the problems of earthquake and winds.

Although it has not been traditionally available in the prior art of structures for human habitat to change its overall form from Summer to Winter, this would indeed be advantageous. In the Winter, a structure might be more advantageous if it could keep its profile close to the ground and avoid the prevailing winds and inclement weather. Also, it would be advantageous if a structure could change the orientation of its surfaces to follow the Sun in Winter to increase heat gain. The opposite is also possible under other certain parameters. For example, in Winter, large deep space recess volumes are more efficient to heat than spread out narrow ranging volumes, which inherintly have more surface per volume through which is loose heat. In Summer, it might be advantageous to spend more time outdoors, and therefore require less indoor volume. It is also possible that under certain conditions a structure for human habitat may best cool itself in Summer by opening up a large interior space to let the prevailing wind, pass through it.

In short, structures of the prior art have been devised which when once erected in their final configuration, are rigidly formed in that position, and only through extreme and impractical means may they be altered. Buildings systems of the prior art are not available which can economically achieve a reconfiguration and remodeling with the changes of the seasons, or which can flex their shapes and be variable to thereby resist the forces of earthquakes and wind.

OBJECTS AND ADVANTAGES

Accordingly, the several objects and advantages of my invention are to create a variable polyhedral framework, which can easily modify its shape, without requiring a dismantling and re-erecting. This would mean that a structure according to the present invention could change its orientation to follow the Sun as the day and the seasons progress, and also take advantage of prevailing micro-climatic conditions such as wind, and could also change its shape and orientation to take advantage of changing views from the site of the structure. Therefore the finished rigid perimeter of the polyhedral framework so formed according to the teaching of the present application may be, for example, a substantially planar form, or cylindrical, ellipsoid, spherical or other curvilinear form, or may be formed into a columnar framework, or a parabolic or a hyperparabolic form. The structure taught according to the present application may also be formed into a combination of the abovementioned geometric shapes. These various possible shapes which may be formed using the device of the present application, may each be formed from the same framework having the exact same parts continuously connected to one another, according to the device of the present application, without dismantling and re-erecting of the framework, but only by modifying the locations of the various struts in relation to one another.

In addition, the variable nature of the struts and the connectors of the invention, will allow for the flexing of the entire structure according to the present application, which allows for the resistance and absorbtion of forces due to earthquakes and wind.

Further objects andadvantages of my invention will become apparent from a consideration of the drawings and ensuing description of it.

DRAWING FIGURES

DRAWING REFERENCE NUMERALS

Figure 1:
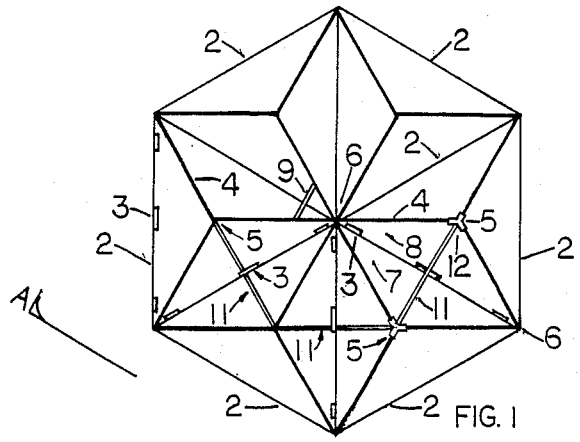
FIG. 1 shows a top elevational view of a portion of a structure according to the invention.
Figure 5:
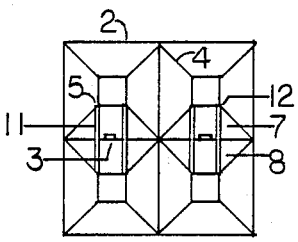

2 base edge
3 hinge means 4 non-base edge
5 vertex of non-base edges
6 vertex of base and non-base edges
7 polyhedron
8 adjacent polyhedron
9 strut to make rigid
11 lengthening and shortening means
12 connector for 11
13 segmented lengthening and shortening means
14 ball and socket means
15 variable connection
16 segmented joint connector means
17 fastener

VARIABLE POLYHEDRAL FRAMEWORK

FIG. 1 shows a top elevational view of a framework according to the present application. FIG. 1 is comprised of six adjacent polyhedrons. Polyhedron 7, is adajcent to polyhedron 8. The polyhedrons are comprised of base edges 2, and non-base edges 4. The adjacent polyhedrons are joined along their base edges 2, and are joined by a hinged means 3. The several non-base edges are joined in a vertex 5. A lengthening and shortening means 11, is attached to two vertices 5. These two vertices may be of adjacent polyhedrons as shown in polyhedron 7 and 8, or might be opposite or other non-adjacent polyhedrons. A locking means 9, holds two polyhedrons in relationto each other. A control means 12, is located at a vertex 5, and may lock or otherwise resist or control the lengthening and shortening means 11. A vertex of both base and non-base edges is located at a point 6, and contains a sliding means, which may be a multiple ball and socket means, which is shown in detail in FIG. 4.

Figure 2:
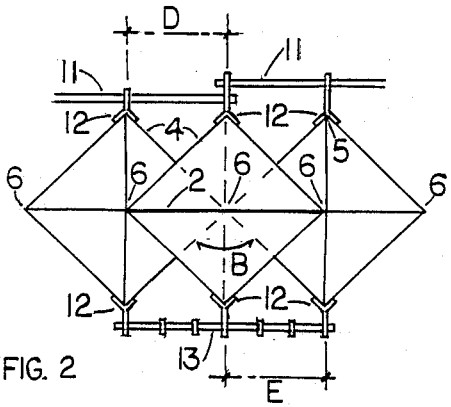
FIG. 2 shows a side elevational view taken about line A—A in FIG. 1.

FIG. 2 shows a side elevational view of the device of FIG. 1 taken along line A—A. Dimension D, and dimension E, show the respective lengths of the lengthening and shortening means 11, when the device of FIG. 1 takes the form of a planar framework. Angle B, shows the angle between twonon-base edges 4, when the device is a planar framework. A segmented lengthening and shortening means 13, is shown.

Figure 3:
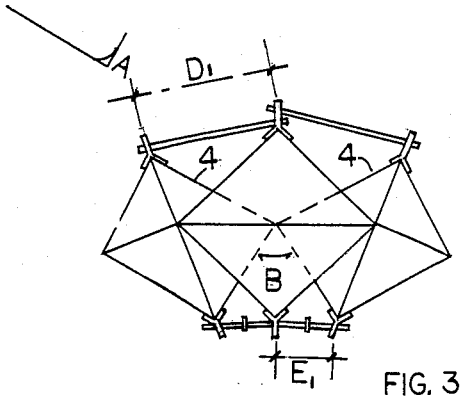
FIG. 3 shows the same side elevational view of FIG. 20, in a variable position.

FIG. 3 shows the device of FIG. 1 in a configuration different from that of FIG. 2. THe dimensions D and E, have become respectively larger and smaller, now called D1 and E1, and angle B is a smaller angle now called B1.

Figure 4:
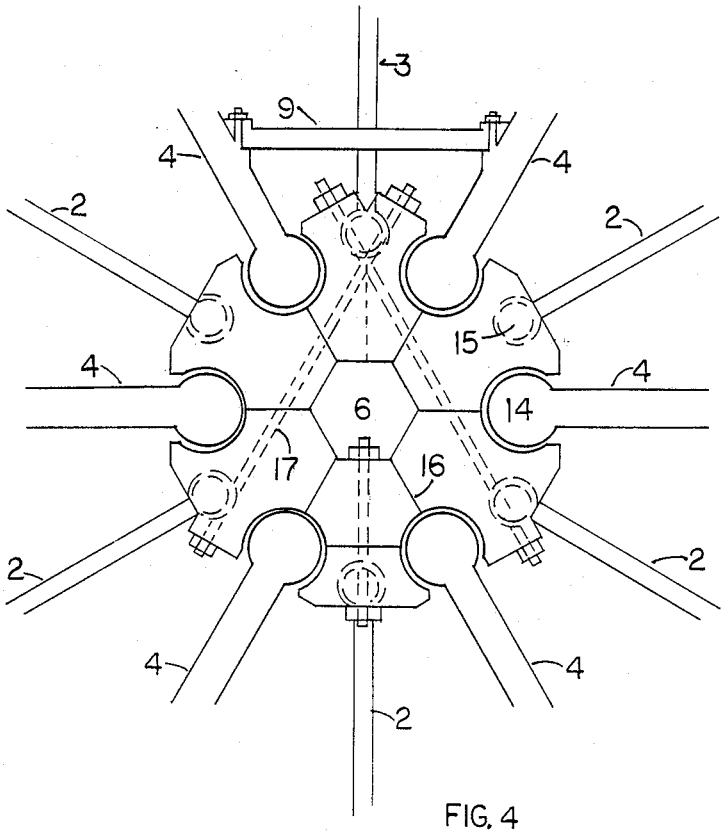
FIG. 4 shows a vertex receiving the several struts of several polyhedrons.

FIG. 4 is a plan elevational view, seen close up, of the vertex 6, showing a possible preferred embodiment of the joinder of the base edges and the non-base edges of the several adjacent polyhedrons. Ball and socket joints are shown at the ends of the struts comprising the edges, as is a stiffening device, the strut to make rigid, 9.

VARIABLE POLYHEDRAL FRAMEWORK-OPERATION

In the device according to the teaching of my invention, a Polyhedral Framework is formed, FIG. 1. This framework is comprised of the joining of at least two polyhedrons 7, and 8, being at least tetrahedrons, which are joined along their abutted, coincident base edges, 2. The polyhedrons of the invention may be formed of linear strut members, or may be formed of a substantially closed planar panel surface or the like. At the base edges 2, a hinged means 3, allows for the relative movement between the two adjacent polyhedrons 7, and 8. The non-base edges 4, of the polyhedron meet at a point 5, and there at the vertex of the polyhedrons' sides, a control means 12, allows for the locking or other control of the lengthening and shortening means 11.

In FIG. 2, the framework is in a planar configuration and the dimension D, of the lengthening and shortening means is shown, and also the dimension E of the lengthening and shortening means, which shows three segments, as well as the angle B, between the non-base edges 4, for this planar embodiment.

In FIG. 3 the frameworkhas moved out of the planar configuration and takes a bent, faceted curvilinear form. This has been allowed by the movement of the adjacent polyhedrons relative to one other, through the base edges being hinged 3, and the increase of dimension D which is now a larger dimension D1, and the shortening of dimension E which is now a smaller E1, and shows only two segments, and by the change in the angle between the two polyhedrons B, which is now a smaller B1. The lengthening and shortening means at dimension D, is a slidable means, which may be controlled by a geared or other gripping or locking means, and the lengthening and shortening means at dimension E shows a segmented means, which segments may be added or removed to change the dimension. These different means of lengthening and shortening are interchangeable, it is only required that a means be provided to change the dimensions D, and E, which through the lengthening and shortening means are connected to the each of the vertices of the sides of the two adjacent polyhedrons.

FIG. 4 shows a closer view of the joinder 6, of the two polyhedrons, at the meeting of both their base and non-base edges. The ends of the non-base edges 4, show a ball and socket means 14, joined through a segmented joint connector means 16 by bolts or other fasteners 17 to the base edges 3 having a variable means being either a ball and socket means or a hinge means at their ends. A means to make the framework rigid 9, may be placed between at least two of the base or non-base edges, thereby additional triangulation may be had.

While FIGS. 1–4 show a preferred embodiment of the device of my invention, other similar forms of the device would incorporate all of its teachings.

For example the minimum device of my invention would include two tetrahedrons, joined by a hinged means at one coincident base edge of each tetrahedron and having a variable means attached between the two vertices of the sides of each tetrahedron.

Many other embodiments are possible using the features of my invention. For example other polyhecrons may be used as in the plan view elevation FIG. 18, which shows a quadrilateral based polyhedron. However the present invention could also include other embodiments using five, six, eight or other convenient many-sided based polyhedrons. It may also be seen in FIG. 18 that that the vertices of the sides of the polyhedrons according to the teaching of my invention may be truncated.

While the above description contains many specificities, the reader should not construe these as limitations on the scope of the invention, but merely as exemplifications of preferred embodiments thereof. Those skilled in the art will envision many other possible variations that are within its scope. For example skilled artisans will readily be able to change the dimensions and shapes of the various embodiments. They will also be able to make the framework of alternative materials, such as plastic, wood, steel, ferrocement, composites, and the like. They can make many variations on the hinge means, lengthening and shortening means, control means, and variable vertex of base and non-base edge means. They can make the framework of linear strut members or of substantially planar panel members. Accordingly the reader is requested to determine the scope of the invention by the appended claims and their legal equivalents, and not by the examples which have been given.

What is claimed is:

1. A variable polyhedral framework formed from a plurality of rigid polyhedrons arranged in a nonlinear array over a planar surface each polyhedron having at least one base edge, a plurality of non-base edges, at least one vertex of base and non-base edges, and at least one non-base vertex, each of said polyhedrons of said framework being hingedly joined to at least one adjacent polyhedron by a hinge means provided at said at least one base edge, by a variable means at said vertex of base and non-base edges, and by a variable means between said non-base vertexes of said adjacent polyhedrons whereby the framework may be curved or angularly adjusted in three directions.

2. The device according to claim 1 in which additional rigidifying members are located at a point along the length of a non-base edge of each of said adjacent polyhedrons.

* * * * *